United States Patent [19]

Lessway

[11] 4,399,639

[45] Aug. 23, 1983

[54] TRUE CENTERING STEADY REST

[76] Inventor: Richard J. Lessway, 25547 Ridgewood Dr., Farmington Hills, Mich. 48018

[21] Appl. No.: 266,996

[22] Filed: May 26, 1981

[51] Int. Cl.[3] ..... B24B 41/06

[52] U.S. Cl. ..... 51/238 S; 82/38 R; 409/165

[58] Field of Search ..... 51/103 WH, 103 R, 238 S; 409/165, 225; 82/38 R, 39

[56] References Cited

U.S. PATENT DOCUMENTS 3,535,963 10/1970 Dietl ..... 82/38 R 4,276,723 7/1981 Fournier ..... 51/238 S

*Primary Examiner*—James G. Smith

*Assistant Examiner*—Douglas D. Watts

*Attorney, Agent, or Firm*—Robert G. Mentag

[57] ABSTRACT

A true centering steady rest for rotatably supporting an elongated cylindrical workpiece for a metal working operation on the outer diameter of the workpiece, such as a grinding operation. The steady rest includes a housing in which is slidably mounted a pusher arm carrying a workpiece center wear pad. A pair of side arms are slidably mounted on said pusher arm. Each side arm carries a replaceable wear pad engageable with a workpiece at a point in the range from 90°-140° from the center wear pad. The center and side wear pads are moved into operative engagement with a workpiece when the pusher arm is moved toward the workpiece, and they are disengaged from the workpiece when the pusher arm is moved away from the workpiece.

10 Claims, 14 Drawing Figures

TRUE CENTERING STEADY REST

BACKGROUND OF THE INVENTION

1. Field of the Invention

This invention relates to the steady rest art, and more particularly, to a novel and improved true centering steady rest. The invention is specifically concerned with a steady rest that is particularly adapted for use in conjunction with grinding machines, lathes, and similar machine tools.

2. Description of the Prior Art

It is well known in the machine tool art to employ steady rests for rotatably supporting elongated cylinder workpieces for grinding machine operations and the like. A disadvantage of the prior art steady rests is that they are complex and expensive to make, and time consuming to adjust them to various size diameter workpieces. Many of the prior art steady rests employ roller structures for engaging a workpiece, and such roller structures are disadvantageous, since the rollers get in the way of a grinding wheel when smaller diameter workpieces are held in such roller structure type steady rests during a grinding operation. Examples of such disadvantageous prior art steady rests are illustrated in U.S. Pat. Nos. 1,213,574; 1,961,091; 2,160,378; 3,145,513; 3,234,829; 3,320,839; 3,330,074; 3,427,762; 3,535,963; 3,736,114; 4,195,448; and 4,205,492.

SUMMARY OF THE INVENTION

In accordance with the present invention, the true centering steady rest comprises three wear pads which rotatably support a cylindrical workpiece at three points around the periphery of the workpiece. The steady rest of the present invention eliminates chatter and run-out, and it maintains a workpiece in a steady position while the outer diameter is being ground or machined in some other manner. The steady rest of the present invention is adapted to hold various size diameter workpieces without the need for readjusting the steady rest, and without having to repeatedly find the longitudinal center of a workpiece.

The steady rest of the present invention includes a housing which comprises a central body and two side cover plates. A pusher arm is slidably mounted inside of the housing, and it is provided with a shaft on one end for moving the pusher arm manually or for moving it by a power means. The other end of the pusher arm carries a replaceable wear pad. A pair of wear pad carrier side arms are slidably mounted on the pusher arm, and they are operatively connected to a cam means, whereby when the pusher arm is moved in a direction toward a workpiece, the three wear pads are each moved along a straight travel path into rollable supporting engagement with the outer diameter of the workpiece, and when the pusher arm is moved in a direction away from the workpiece, the three wear pads are each retracted along their respective straight travel path from the workpiece to release the same.

DESCRIPTION OF THE PREFERRED EMBODIMENT

Figure 1:
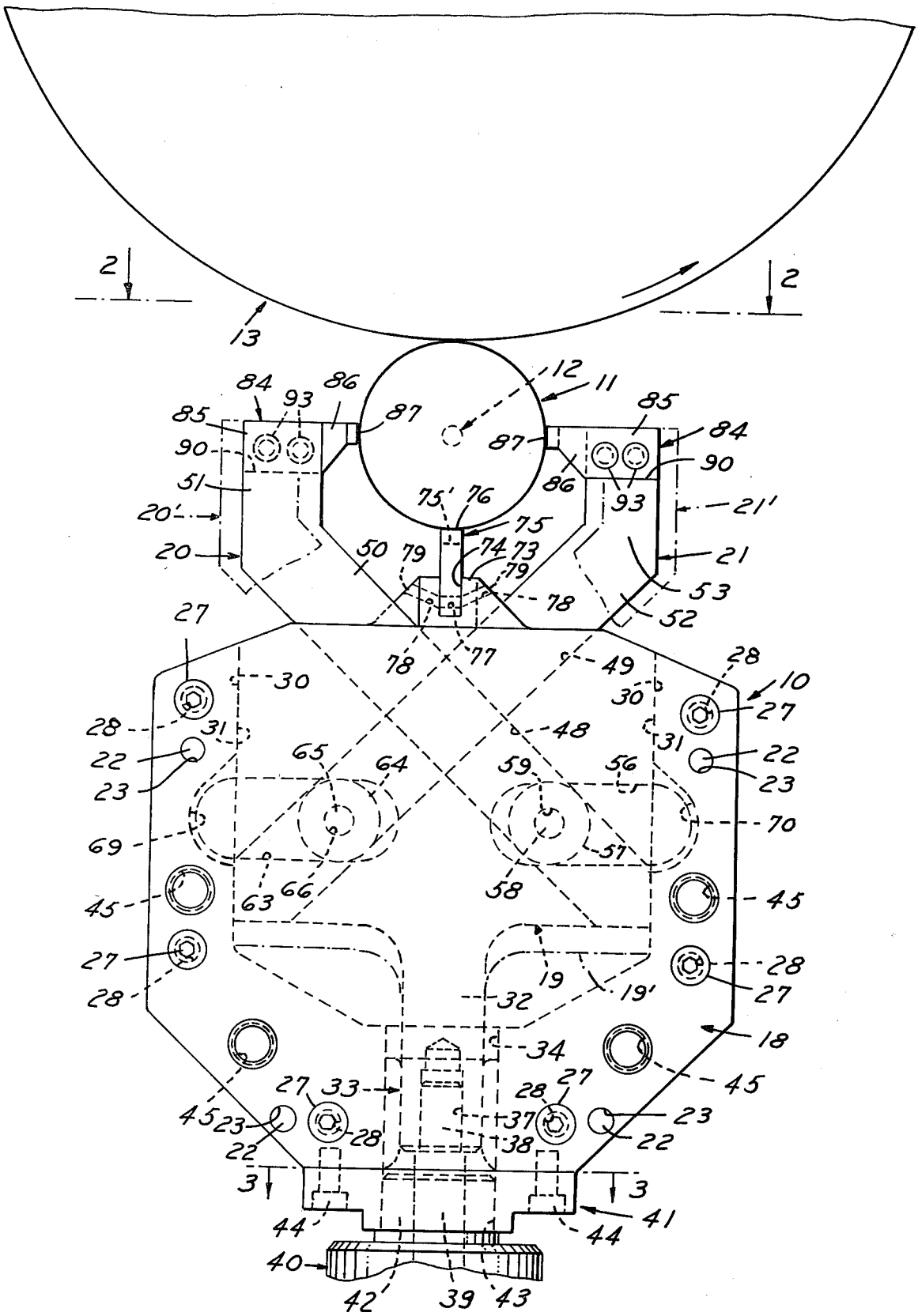
FIG. 1 is a side elevation view of a true centering steady rest made in accordance with the principles of the present invention.

Referring now to the drawings, and in particular to FIG. 1, the numeral 10 generally designates a true centering steady rest made in accordance with the principles of the present invention. The numeral 11 designates an elongated cylindrical workpiece, as for example, an elongated shaft which is to be ground on the outer diameter thereof by a rotating grinding wheel, generally indicated by the numeral 13. The numeral 12 generally designates the minimum diameter, or size, of a workpiece which can be rotatably supported in the same size structure that may be used for the larger diameter workpiece 11. For example, in one embodiment the steady rest was capable of rotatably supporting a shaft $2\frac{1}{4}''$ in diameter, and it could be adjusted to support an elongated cylindrical shaft of $\frac{1}{4}''$ outer diameter.

The true centering steady rest of the present invention is illustrated as being used with a grinding machine. However, it will be understood that it may also be used with other machine tools to prevent workpiece run-out, as for example, in a lathe. In FIG. 1, the workpiece 11 is illustrated as being rotated on a horizontal axis with the grinding wheel 13 being supported on a horizontal axis, and with the longitudinal axis of the steady rest 10 being disposed on the vertical plane.

Figure 2:
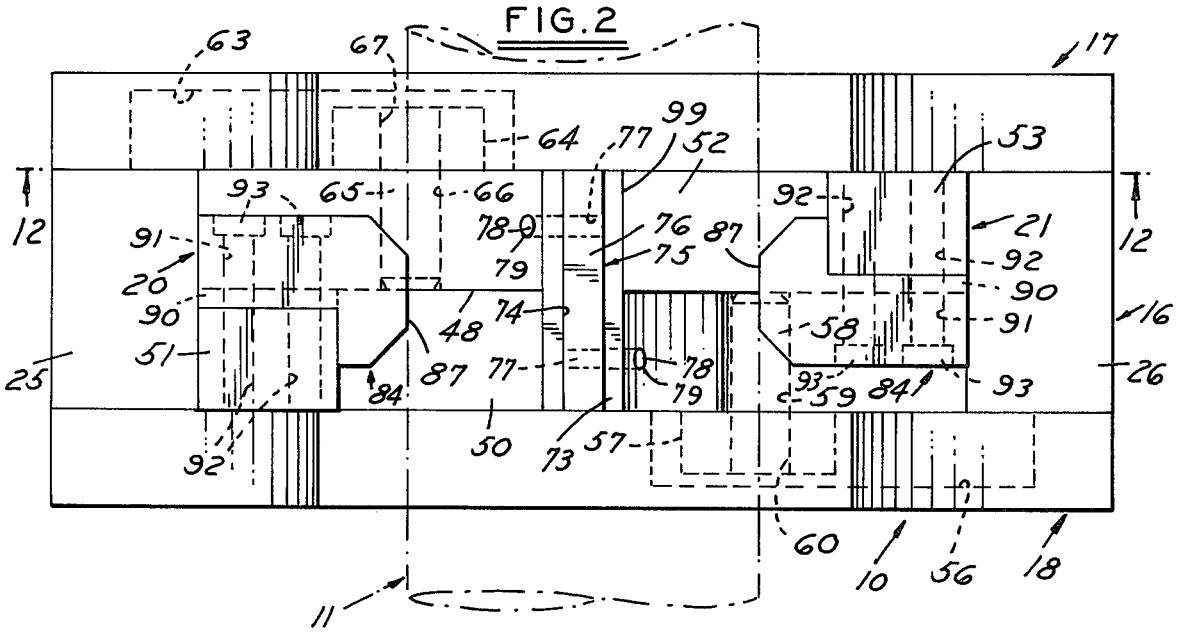
FIG. 2 is a fragmentary, enlarged, top view of the steady rest structure illustrated in FIG. 1, taken along the line 2—2 thereof, and looking in the direction of the arrows.
Figure 3:
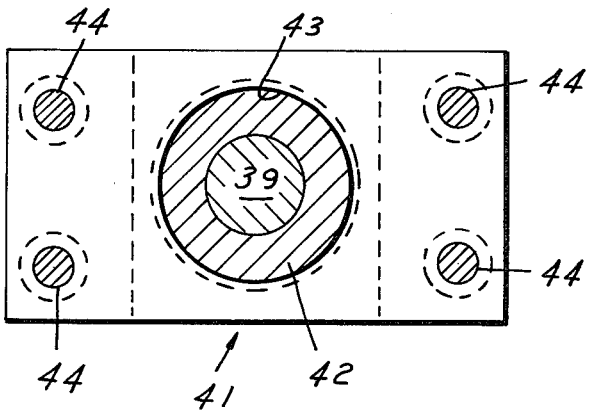
FIG. 3 is a horizontal section view of the steady rest structure illustrated in FIG. 1, taken along the line 3—3 thereof, and looking in the direction of the arrows.
Figure 4:
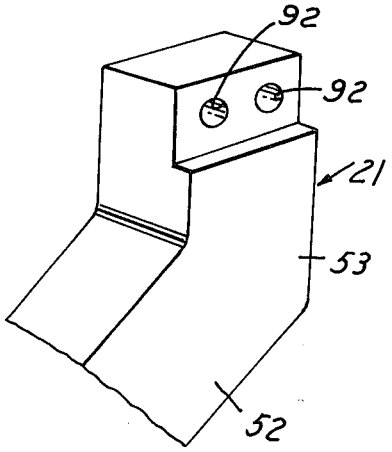
FIG. 4 is a fragmentary, elevation perspective view of the upper end of one of the steady rest movable arms.
Figure 5:
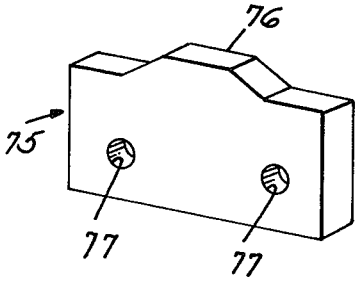
FIG. 5 is an elevation perspective view of the replaceable center rest pad employed in the invention.
Figure 10:
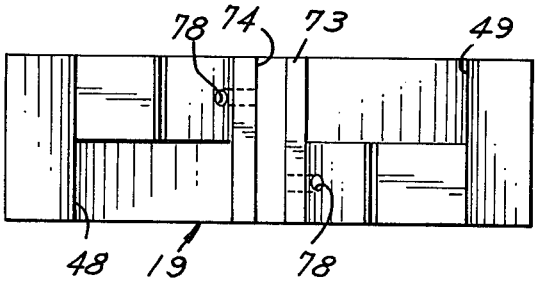
FIG. 10 is a top plan view of the pusher arm structure illustrated in FIG. 9, taken along the line 10—10 thereof, and looking in the direction of the arrows.
Figure 11:
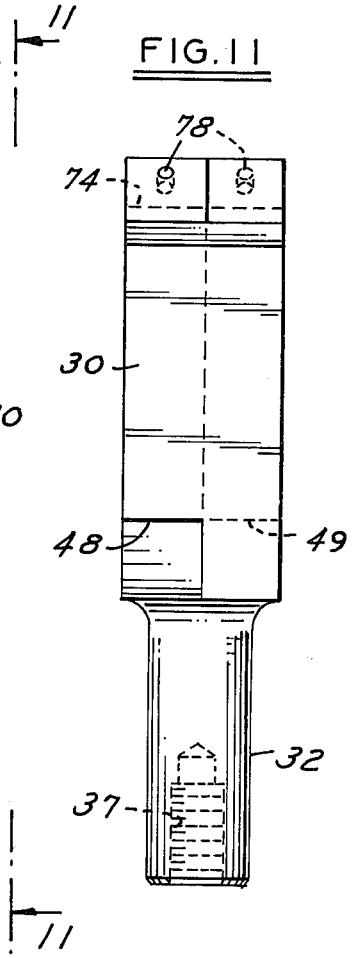
FIG. 11 is a right side elevation view of the pusher arm structure illustrated in FIG. 9, taken along the line 11—11 thereof, and looking in the direction of the arrows.

As shown in FIGS. 1 and 2, the steady rest of the present invention includes a housing comprising a central body, generally indicated by the numeral 16 (FIG. 2) and a pair of cover plates which are generally indicated by the numerals 17 and 18. Slidably mounted within the steady rest housing is an axially movable pusher or operator, generally indicated by the numeral 19. The pusher arm 19 is shown in detail in FIGS. 9, 10 and 11. As shown in FIGS. 1 and 2, the steady rest 10 includes a pair of side arms, generally indicated by the numerals 20 and 21.

Figure 7:
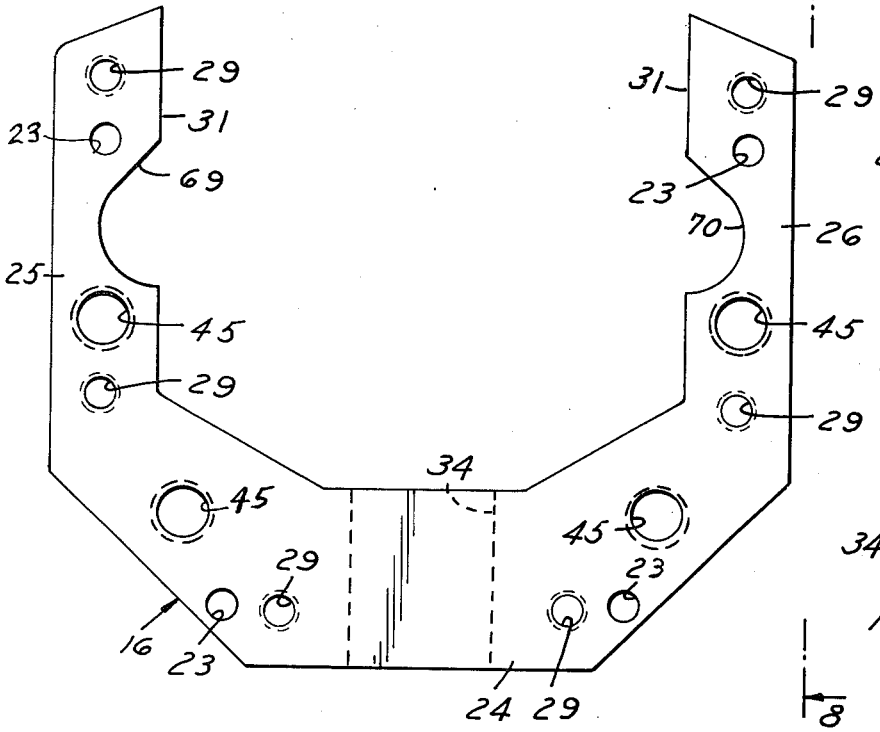
FIG. 7 is a side elevational view of the steady rest body.
Figure 8:
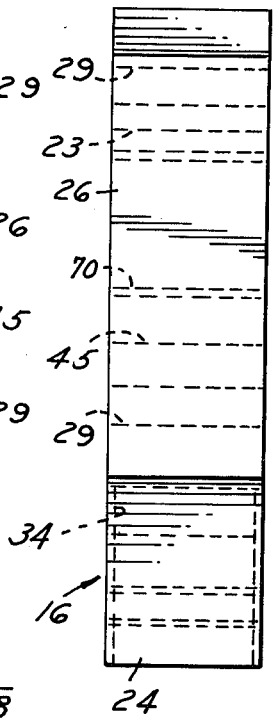
FIG. 8 is a left side view of the steady rest body illustrated in FIG. 7, taken along the line 8—8 thereof, and looking in the direction of the arrows.

As shown in FIGS. 7 and 8, the central body 16 includes a base or bight portion 24 and a pair of side portions 25 and 26, integrally attached at the outer ends of the bight portion 24.

Figure 12:
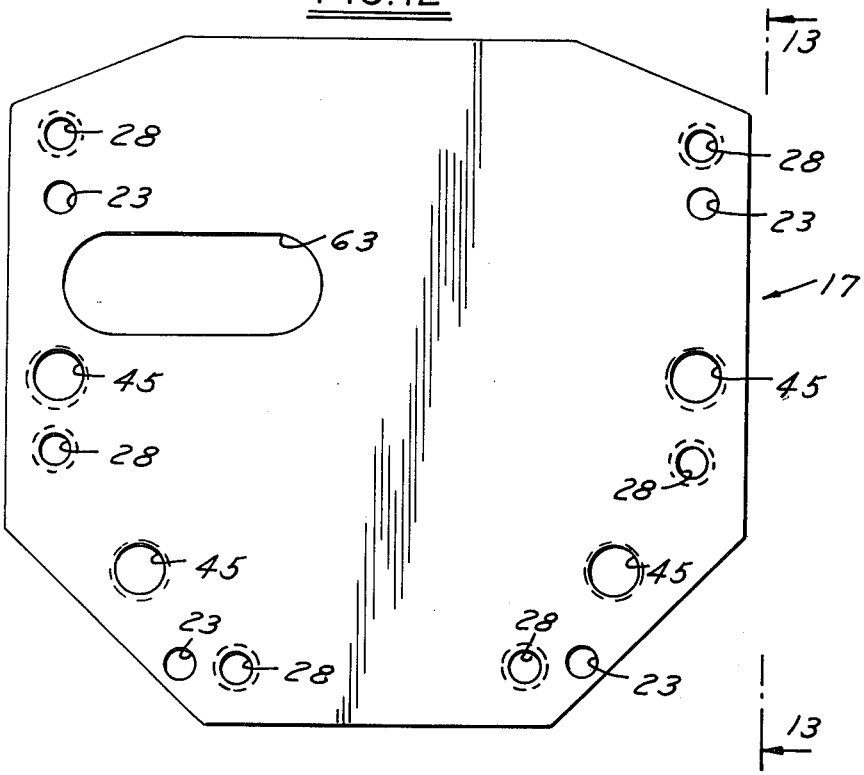
FIG. 12 is a side elevation view of the inside surface of one of the identical cover plates employed in the steady rest structure illustrated in FIG. 2, taken along the line 12—12 thereof, and looking in the direction of the arrows.

As shown in FIG. 1, the side cover plate 18 is releasably secured to one side of the central body 16 by a plurality of suitable machine screws 27 which are mounted through suitable bores 28 formed through the cover 18, and into threaded engagement with suitable threaded bores 29 (FIG. 7) formed in aligned positions in the central body 16. As shown in FIG. 12, the cover 17 is also provided with suitable bores 28 for reception of similar machine screws 27 for releasably securing the cover plate 17 to the other side of the threaded bores 29 in the body 16. The cover plates 17 and 18 are also joined to the central body 16 by a plurality of suitable dowel pins 22 that extend through suitable aligned holes 23 in the cover plates 17 and 18 and the central body 16.

As shown in FIG. 1, the pusher or operator arm 19 is slidably mounted within the central body 16, with its parallel side faces 30 being in slidable contact with the parallel inner faces 31 of the central body side portions 26. The pusher or operator arm 19 is provided with an integral, axially disposed, longitudinally extended cylindrical shaft 32 on the lower end thereof, as viewed in FIG. 1. The shaft 32 is slidably mounted in a suitable bushing 33 which is operatively mounted in a central axial bore 34 formed through the bight or base portion 24 of the body 16.

As shown in FIG. 1, the pusher arm shaft 32 is provided with an axial, threaded bore 37 which extends inwardly from the outer end thereof, and in which is threadably received the threaded end 38 of a cylinder rod 39. The cylinder rod 39 is the cylinder rod of a conventional fluid cylinder, generally indicated by the numeral 40, which may be either a hydraulic cylinder or a pneumatic cylinder. The cylinder 40 is provided with a threaded housing end 42 which is threadably mounted in a threaded bore 43 in a cylinder adaptor, generally indicated by the numeral 41. The cylinder adaptor 41 is releasably secured to the central body 16 by a plurality of suitable machine screws 44. Although a fluid cylinder 40 has been shown as being provided for moving the pusher arm 19 between operative positions, as described hereinafter, it will be understood that the pusher arm 19 may also be moved by any other suitable power means, or by a manually operated means.

The steady rest 10 is adapted to be supported in the vertical position shown in FIG. 1 relative to the grinding wheel 13 by any suitable mounting structure, and be attached thereto by a plurality of suitable mounting screws that are mounted through a plurality of threaded bores 45 that are formed through both of the cover plates 17 and 18, and the central body 16.

Figure 9:
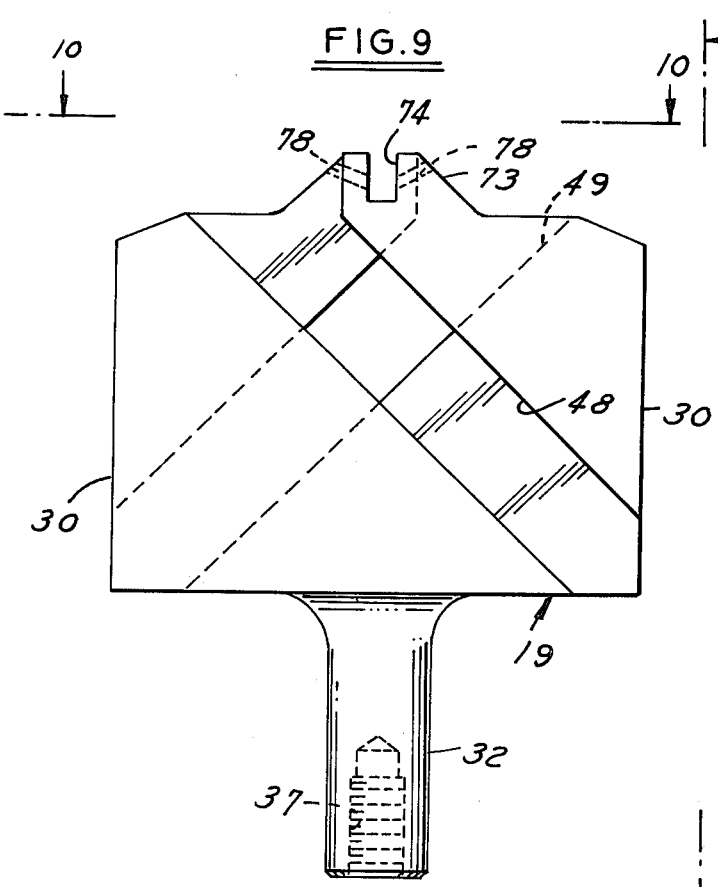
FIG. 9 is a side elevation view of a pusher arm employed in the steady rest structure illustrated in FIG. 1.

As shown in FIGS. 1 and 9, the pusher arm 19 is provided with a pair of slide tracks or slots 48 and 49 which are rectangular in cross section. The slots 48 and 49 are disposed on opposite sides of the pusher arm 19 which is rectangular in cross section. The slots 48 and 49 are disposed at right angles to each other, and they are disposed at a 45° degree angle relative to the longitudinal axis of the pusher arm 19.

As shown in FIG. 1, the side arm 20 includes an angular portion 50 and an integral longitudinal portion 51. The angular portion 50 is disposed at an angle of 45° from the longitudinal axis of the pusher arm 19, and it is slidably mounted in the pusher arm slot 48. The side arm 21 also includes an angular portion 52 and an integral longitudinal portion 53. The angular portion 52 is disposed at an angle of 45° from the longitudinal axis of the pusher arm 19, and it is slidably mounted in the pusher arm slot 49.

As shown in FIGS. 1 and 2, the cover plate 18 is provided with a transverse, horizontal cam slot 56 which is perpendicular to the longitudinal axis of the pusher arm 19, and which has rounded ends. A cam roller 57 is rollably mounted in the cam slot 56. A dowel pin 58 has one end fixedly mounted, as by a press fit, in a bore 59 formed in the inner end of the arm portion 50 of the side arm 20. The other end of the dowel pin 58 is rollably mounted in the axial bore 60 (FIG. 2) of the cam roller 57.

As shown in FIGS. 1 and 2, the cover plate 17 is provided with a transverse, horizontal cam slot 63 which is perpendicular to the longitudinal axis of the pusher arm 19 and which has rounded ends. A cam roller 64 is rollably mounted in the cam slot 63. A dowel pin 65 has one end fixedly mounted, as by a press fit, in a bore 66 formed in the inner end of the arm portion 52 of the side arm 21. The other end of the dowel pin 65 is rollably mounted in the axial bore 67 (FIG. 2) of the cam roller 64.

As shown in FIGS. 1 and 7, the central body side portions 25 and 26 are each provided with an arcuate recess 69 and 70, respectively, on the inner side thereof. The recesses 69 and 70 are aligned with the outer rounded ends of the cam slots 56 and 63, respectively.

Figure 6:
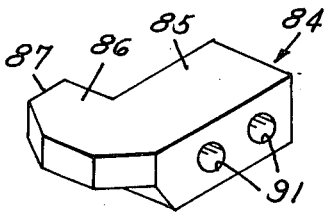
FIG. 6 is an elevation perspective view of one of the replaceable side rest pads employed in the invention.

The pusher arm 19 has an integral, central, axial extension on the front end thereof indicated by the numeral 73 (FIGS. 1 and 9). The pusher arm extension 73 is provided with a rectangular slot 74 which is disposed 90° to the cam slots 56 and 63. A center, replaceable wear pad, generally indicated by the numeral 75 is seated in the slot 74. As shown in FIG. 6, the wear pad 75 is substantially rectangular in shape, and it is provided with an extension wear nose 76 that slidably engages the workpiece 11. The wear pad 75 is provided with a pair of bores 77. As shown in FIGS. 1, and 9–11, the axial extension 73 is provided with a pair of threaded bores 78, the inner ends of which communicate with the bores 77 in the wear pad 75. The wear pad 75 is releasably secured in the slot 74 by a pair of suitable cap screws 79 which are threadably mounted in the threaded bores 78 and have their inner ends extended into the bores 77 in the wear pad 75 to hold it in place in the slot 74.

Each of the side arms 20 and 21 carries a replaceable wear pad, generally indicated by the numeral 84 (FIGS. 1, 2 and 6). As best seen in FIG. 6, each of the wear pads 84 includes a rectangular body portion 85 with an integral right angle portion 86 which has a workpiece engaging wear end 87. Each of the wear pads 74 is provided with a pair of parallel bores 91 which are aligned with a pair of threaded bores 92 in the side arms 20 and 21 (FIG. 2). Each of the wear pad body portions 85 sits on a shoulder 90 on their respective side arm portion 51 and 53, and they are each secured to their side arm by a pair of suitable cap screws 93.

In the embodiment of FIG. 1, the wear pad wear ends 87 slidably engage the workpiece 11 at diametrical opposite points which are each 90° away from the point at which the wear nose 76 slidably engages the workpiece 11.

FIG. 1 shows the steady rest 10 in operative engagement with a large workpiece 11 whereby the wear pads 84 and 75 are engaging the workpiece 11 at three different positions. Two of the workpiece engagement positions are dimeterically opposite each other, and one such position is at 90° between the first two mentioned positions. The steady rest 10, as shown in FIG. 1, is in a workpiece engaging position. In order to release the workpiece 11, the cylinder 40 is actuated so as to move the pusher arm 19 downwardly, as viewed in FIG. 1, to the broken line position indicated by the numeral 19'. The downward movement of the pusher arm 19 causes the side arms 20 and 21 to be moved straight outwardly to the broken line positions indicated by the numerals 20' and 21'. The straight outward movement of the arms 20 and 21 is caused by the camming action between the slots 48 and 49, and the arm portions 50 and 52 sliding in said slots. The cam rollers 64 and 57 also function with the cam slots 63 and 56, respectively, to restrain the arms 20 and 21 from moving axially with the pusher arm 19. The downward movement of the pusher arm 19 also retracts the wear pad 75 downwardly to the broken line position indicated by the numeral 75'.

After the finished workpiece 11 has been removed, and a new workpiece 11 in its position between the wear pads, the cylinder 40 is actuated in the other direction to move the pusher arm 19 back to the upward operative position so as to cam the side arms 20 and 21 transversely inward on straight lines, to engage the wear pads 84 with the new workpiece at dimeterically opposite positions, and to move the wear pad 75 straight upwardly into an operative engagement position with the bottom of the new workpiece.

The range of the steady rest 10 may be changed by merely adding different wear pads 84, 85 and 75 with different size tips. The straight inward and outward radial movements of the of the wear pads 84, and the arms 20 and 21, are effected by the 45° disposition of the arm portions 50 and 52 in the mating 45° slots 48 and 49, and the functioning of the cam rollers 57 and 64 with the transverse cam slots 56 and 63, respectively.

Figure 13:
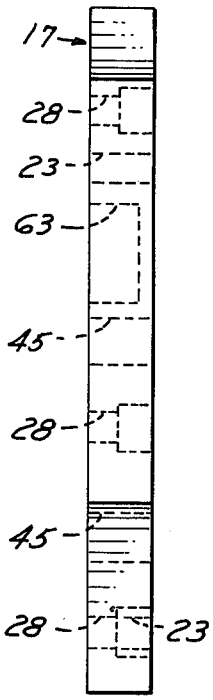
FIG. 13 is a right side elevation view of the cover plate structure illustrated in FIG. 12, taken along the line shown as 13—13 thereof, and looking in the direction of the arrows.
Figure 14:
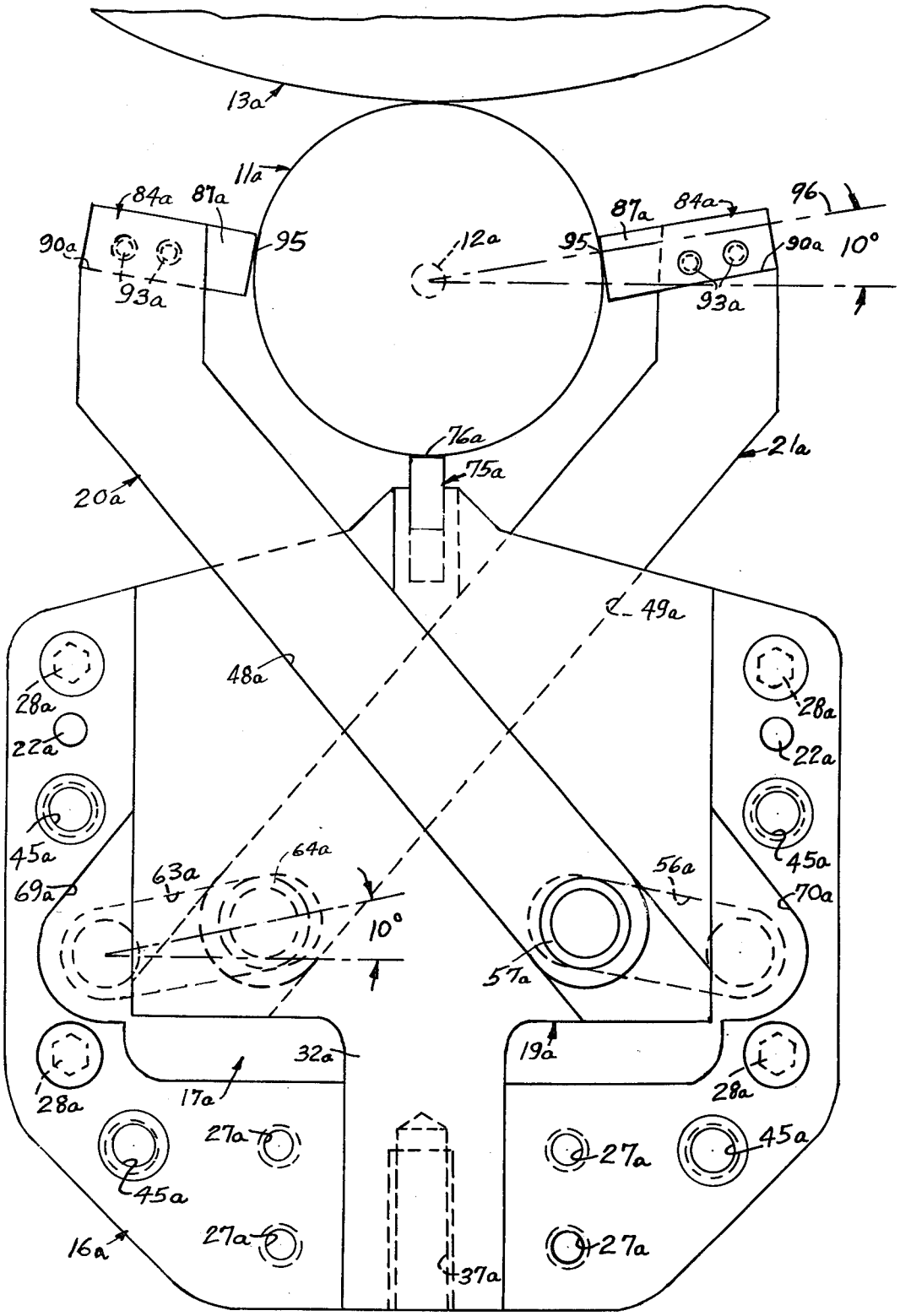
FIG. 14 is a side elevation view, similar to FIG. 1, with a cover plate removed, and showing a second embodiment of the invention.

FIG. 14 illustrates a second embodiment of the invention, and the parts of the second embodiment of FIG. 14 which are the same as the parts of the first embodiment illustrated in FIGS. 1 through 13, are marked with the same reference numerals followed by the small letter "a". The only difference between the embodiment of FIG. 14, and the first embodiment, is the difference in the angular disposition of the side arms 20*a* and 21*a*, the wear pads 84*a*, and the cam slots 56*a* and 63*a*. FIG. 14 shows the cam slots 56*a* and 63*a* disposed at a 10° angle from the horizontal, with the slots disposed in an upwardly and inwardly direction. The pusher arm slots 48*a* and 49*a* are disposed at a 50° angle from the horizontal axis of the steady rest. The wear pads 84*a* are disposed at a 10° angle above the transverse axis of the steady rest so that the rest pads 84*a* contact the workpiece 13*a* at a point 95 above the centerline of the workpiece 13*a*. The wear pads 84*a* travel inwardly and outwardly along the axis lines indicated by the numerals 96. The steady rest illustrated in FIG. 14 functions in the same manner as the first described embodiment with the exception of contacting the workpiece 13*a* at the points 95 above the centerline of the workpiece. It has been found that the side arm slots 48*a* and 49*a* may vary in a range from 45° to 65° from the horizontal axis through the steady rest while the angle of the horizontal axis of the cam slots 56*a* and 63*a* may vary in a range from 0° to 40° above the horizontal. The rest pads 84*a* must also vary in a range from 0° to 40° above the horizontal centerline axis through the workpiece 13*a*. For every one-half degree that the side arm slots 48*a* and 49*a* are formed upwardly from the 45° angle from the horizontal, the cam slots 56*a* and 63*a* and the angular disposition of the rest pads 84*a* above the horizontal axis must vary by 1°. That is, if the angles of the side arm slots 48*a* and 49*a* were at 47½° upwardly from the horizontal axis through the steady rest, the angles of the cam slots 56*a* and 63*a* and the rest pad angle would be 5°.

In the embodiment of FIG. 13, the cover plate 18*a* is removed.

While it will be apparent that the preferred embodiments of the invention herein disclosed are well calculated to achieve the results aforestated, it will be appreciated that the invention is susceptible to modification, variation and change.

What is claimed is:

1. A true centering steady rest for supporting an elongated cylindrical, rotatable workpiece, characterized in that said steady rest includes:

(a) a housing;

(b) a pusher arm slidably mounted in said housing for movement axially toward and away from the longitudinal centerline of a workpiece to be supported, and carrying a wear pad for supporting engagement with a workpiece at a first workpiece engagement position and having flat opposite side surfaces;

(c) a pair of side arms slidably mounted in a pair of side arm angled slots which are disposed in a crisscross manner, and which are formed in said pusher arm, with one side arm slot in one flat side surface of the pusher arm and the other side arm slot in the other flat side surface of the pusher arm;

(d) said side arms each carry a wear pad for supporting engagement with a workpiece;

(e) cam means for restraining each of said side arms against movement axially of the longitudinal axis of the said pusher arm but which permits crosswise movement of the side arms relative to the longitudinal axis of said pusher arm and toward and away from a workpiece to move the wear pads carried by the side arms in a straight line on a workpiece radial line that extends to the workpiece longitudinal centerline; and, (f) means for moving said pusher arm toward and away from said workpiece, whereby when said pusher arm is moved toward the workpiece, the wear pad on the pusher arm and the wear pads on the side arms are moved along straight workpiece radial line travel paths into supporting engagement with the workpiece, and when the pusher arm is moved away from the workpiece, the wear pads are retracted from the workpiece along the same straight workpiece radial line travel paths.

2. A true centering steady rest as defined in claim 1, characterized in that said housing includes:

(a) a central body portion; and, (b) a side plate mounted on each side of the central body portion for enclosing the same.

3. A true centering steady rest as defined in claim 2, characterized in that:

(a) said side arm slots are each disposed at an acute angle relative to the longitudinal axis of the pusher arm, with each side arm slot being disposed with its upper end on one side of said longitudinal axis.

4. A ture centering steady rest as defined in claim 3, characterized in that:

(a) said means for moving said pusher arm comprises a power means.

5. A true centering steady rest as defined in claim 3, characterized in that said cam means includes:

(a) a first crosswise cam slot formed in one side plate and a cam roller rollably mounted in said first crosswise cam slot and being attached to a first one of said side arms; and, (b) a second crosswise cam slot formed in the other side plate, and a cam roller rollably mounted in said second crosswise cam slot and being attached to a second one of said side arms.

6. A true centering steady rest as defined in claim 5, characterized in that:

(a) said wear pads on said side arms and said pusher arm are detachably mounted on said side arms and said pusher arm.

7. A true centering steady rest as defined in claim 1, characterized in that:

(a) the wear pad straight travel paths are disposed at a right angle to the longitudinal axis of the pusher arm.

8. A true centering steady rest as defined in claim 1, characterized in that:

(a) the wear pad straight travel paths are disposed at an acute angle, selected from the range of 0° to 40°, from a transverse axis at a right angle to the longitudinal axis of the steady rest and toward the workpiece.

9. A true centering steady rest as defined in claim 3, characterized in that:

(a) the side arm slots are disposed at an acute angle selected from the range of 45° to 65°, from a transverse axis at a right angle to the longitudinal axis of the steady rest, and angled toward the workpiece.

10. A true centering steady rest as defined in claim 5, characterized in that:

(a) the cam slots are disposed at an acute angle, selected from the range of 0° to 40°, from a transverse axis at a right angle to the longitudinal axis of the steady rest and angled toward the workpiece.

* * * * *